United States Patent [19]

Steinmann et al.

[11] 4,167,906

[45] Sep. 18, 1979

[54] RAILWAY VEHICLE BOGIES

[75] Inventors: Friedrich Steinmann, Weisslingen; Emil Finsterwald, Winterthur; Ernest Kreissig, Seuzach, all of Switzerland

[73] Assignee: Schweizerische Lokomotiv- und Maschinenfabrik, Winterthur, Switzerland

[21] Appl. No.: 816,719

[22] Filed: Jul. 18, 1977

[30] Foreign Application Priority Data

Jul. 23, 1976 [CH] Switzerland ..... 9456/76

[51] Int. Cl.[2] ..... B61F 3/04; B61F 5/20; B61F 5/30; B61F 5/38

[52] U.S. Cl. ..... 105/168; 105/108; 105/117; 105/135; 105/136; 105/175 A; 105/199 R

[58] Field of Search ..... 105/133, 135, 136, 138, 105/165, 166, 167, 168, 174, 108, 117, 175 A, 199 R

[56] References Cited

U.S. PATENT DOCUMENTS

| | | | |
|---|---|---|---|
| 431,554 | 7/1890 | Butterbaugh | 105/168 |
| 1,138,357 | 5/1915 | Curwen | 105/165 X |
| 1,779,751 | 10/1930 | Peters | 105/133 X |
| 1,964,928 | 7/1934 | Delkers | 105/136 X |
| 2,040,262 | 5/1936 | Kruckenberg et al. | 105/174 |
| 2,205,030 | 6/1940 | Bugatti | 105/133 |
| 2,245,333 | 6/1941 | Frei | 105/168 |
| 3,828,692 | 8/1974 | Kreissig | 105/165 |

FOREIGN PATENT DOCUMENTS

| | | | |
|---|---|---|---|
| 1066456 | 1/1954 | France | 105/165 |
| 47691 | 12/1963 | Poland | 105/165 |

*Primary Examiner*—Albert J. Makay
*Assistant Examiner*—Howard Beltran
*Attorney, Agent, or Firm*—Kenyon & Kenyon

[57] ABSTRACT

The drive means for each wheel set is connected via a two bar-like connecting member to an intermediate portion of the bogie frame or to a cross-member in a manner such that longitudinal forces are transferred to the vehicle body. Also, the opposite side of the drive means is mounted on an axle of the wheel set and is connected to the bogie frame in a manner so as to permit the transmission of transverse forces to the bogie frame.

15 Claims, 12 Drawing Figures

Fig. 3
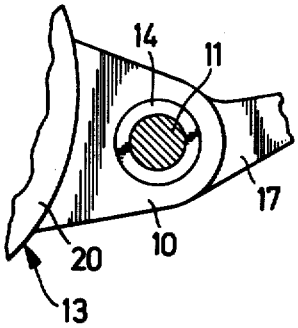
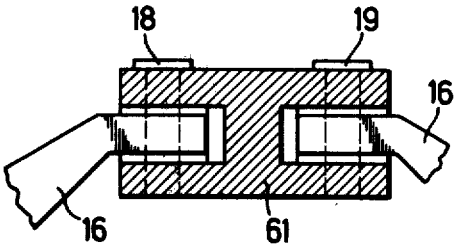
Fig. 6
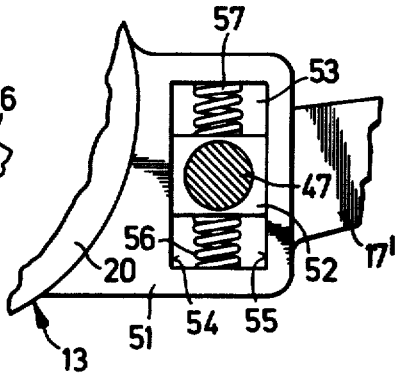
Fig. 7
Fig. 8
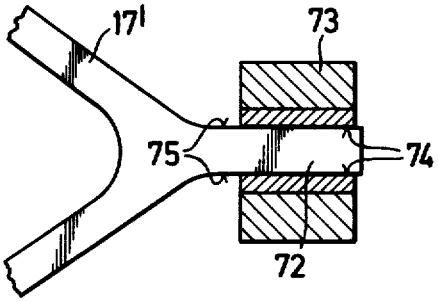

RAILWAY VEHICLE BOGIES

This invention relates to a rail vehicle. More particularly, this invention relates to a mounting arrangement for a drive means of a rail vehicle.

As is known, various types of rail vehicles have been constructed wherein power is supplied directly to the wheels of the vehicle from a power unit or drive means mounted adjacent to the wheels. For example, rail vehicles have been known in which a body is supported on at least two bogies, each of which has at least two wheel sets connected to a respective drive means. Generally, these wheel sets have axles which are mounted in journal bearings, which bearings support a bogie frame thereon. In some cases, the drive means which is usually composed of a driving motor and a gear box, has been resiliently secured to the bogie frame and mounted on the associated wheel set axles so as to be axially fixed. Also, the axles have been guided on the bogie frame so as to be axially fixed. As a result, a rigid connection exists between the drive means and the bogie frame. This, in turn, allows considerable horizontal mass forces to arise between the bogie and the track, particularly when the vehicle is running on a track which is out of horizontal alignment. As a consequence, there is a correspondingly heavy stressing of the cooperating elements.

It is also known for the wheel sets with the associated driving motor to be so disposed as to be movable transversely relative to the bogie frame. This feature helps to reduce the horizontal dynamic forces operative between the bogie and the track, but not to the extent sufficient to ensure a long working life, high reliability of operation and quiet running of the vehicle. This is because the driving motors together with the associated axle form a relatively heavy unit which moves as a whole such that severe lateral impacting may also occur.

Accordingly, it is an object of the invention to provide a rail vehicle with an improved drive system which is of simple and rugged construction.

It is another object of the invention to provide a rail vehicle with a drive mounting arrangement in which very low masses are able to move transversely of a bogie of the vehicle.

Briefly, the invention is directed to a rail vehicle which has a vehicle body which is supported on at least two bogies, each of which includes a frame. In accordance with the invention, at least two wheel sets are mounted in each bogie with each wheel set having an axle and a pair of journal bearings rotatably mounting the axle therein. Further, the journal bearings support a respective bogie frame thereon and are movable at least longitudinally relative to the bogie frame. In addition, a drive mens is operatively connected to a respective wheel set.

Each drive means includes a casing which is interconnected to the vehicle body and to a respective bogie frame. To this end, a pair of bearings are mounted on each axle of the wheel set and is connected to a drive means casing. Also, a first connecting member is connected between the casing and a respective bogie frame in order to transmit transverse forces to the bogie frame. A guide means also connects this connecting member to the bogie frame to permit movement of the connecting member longitudinally of the bogie frame. A second connecting member is also connected between each drive means casing and to the body opposite from the other connecting member in order to transmit longitudinal forces to the body. For this purpose, the connecting member may be directly connected to an intermediate portion of the bogie frame where the bogie frame is, in turn, connected to the vehicle body. Alternatively, the connecting member may be connected to a cross-member which is secured at opposite ends to draw bars which are disposed longitudinally of the vehicle body and are pivotally secured at the respective ends to the cross-member and vehicle body.

The drive means are thus each movably mounted in a guided manner in a vertical plane relative to the respective bogies. In addition, the horizontal position of the drive means is accurately defined.

The mounting arrangement for the drive means ensures an advantageously simple flow of forces between the wheel sets and the vehicle body since the drive means casing transmit substantially all the traction and braking forces. Consequently, the journal axle bearings are stressed to a lesser degree and can be of very simple comstruction since only vertical and axial forces have to be withstood.

Another advantage of the mounting arrangement is that there is much less outlay than previously required in order to ensure a dead parallel adjustment of the axles. Only a single point has to be aligned transversely for each wheel set, whereas in previously known arrangements, two points have to be aligned both transversely and lengthwise. Since each drive means is pivoted to a single pivot, the casings concerned can each pivot around an axis extending substantially longitudinally of the bogie to the normal extent required in rail vehicles for the deflection of the suspension. This deflection permits compensating movements of the axles in accordance with possible horizontal irregularities of the track without detriment to the drive means.

In the embodient wherein a cross member is used to connect the casing to the vehicle body, the traction and braking forces introduced by the wheel sets are kept away by the bogie. Thus, the bogie frame need experience only vertical and transverse stresses.

In order to ensure substantially play-free reliable transverse guiding of the drive means without impairment of the vertical adjustment, the guide means for connecting the connecting member to the bogie frame may include a transverse link which is pivotally connected to the bogie frame and to the connecting member.

A reliable guiding of the drive means can be achieved by means of components which experience little movement and can therefore be rugged. In such a case, the guide means may include a pair of guideways which are parallel to the central longitudinal plane of the bogie with each connecting member having a slider having side surfaces slidably disposed in the guideways.

In order to provide a simple way of altering or correcting the adjustment of each axle, the guide means may include a connecting element which is movably mounted transversely of a bogie frame and a mounting which is secured to the bogie frame for limiting movement of the connecting element. Further, in order to obviate any jerky stressing of the connecting element guiding the drive means, the connecting element and the mounting may cooperate by means of at least one transversely resilient spring element.

In order to adapt the wheel set position to the track conditions, particularly to produce at least a substantial radial position of the axle when the vehicle is negotiating a curve, the mounting may be connected to a control system for adjusting the connecting member.

In order to allow the wheel axles to move freely relative to the bogie frame, the axles are axially fixed in the journal bearings while the bearings are, in turn, movable transversely of the bogie frame. To this end, a spring mmay be secured at each end to and between each bogie frame and each journal bearing. These springs also exert a restoring force on the wheel sets as the transverse deflection of the wheel sets increase.

In order to ensure a differentiated guiding of the wheel sets with an additional degree of freedom, the axles may be mounted for axial movement in the bearings which are connected to the casings of the associate drive means. In addition, the axle is coupled with the drive means by way of a correspondingly axially movable transmission member.

The bearings which are disposed near the drive means can each be guided in vertical and/or axial movement between two guideways which are formed on the casing and which extend transversely of the bogie length.

Conveniently, in order to ensure a quiet running of the rail vehicle and to reduce wear and tear of the cooperating parts of the drive, at least one spring element, which is resilient transversely of the bogie length, is disposed between the casing and the bearings.

These and other objects and advantages of the invention will become more apparent from the following detailed description and appended claims taken in conjunction with the accompanying drawings in which:

FIG. 3 illustrates a view taken on line III—III of FIG. 2;

FIG. 6 illustrates a view taken on line VI-VI of FIG. 5;

FIG. 7 illustrates a view taken on line VII—VII of FIG. 5;

FIG. 8 illustrates a view taken on line VIII—VIII of FIG. 4;

Figure 1:
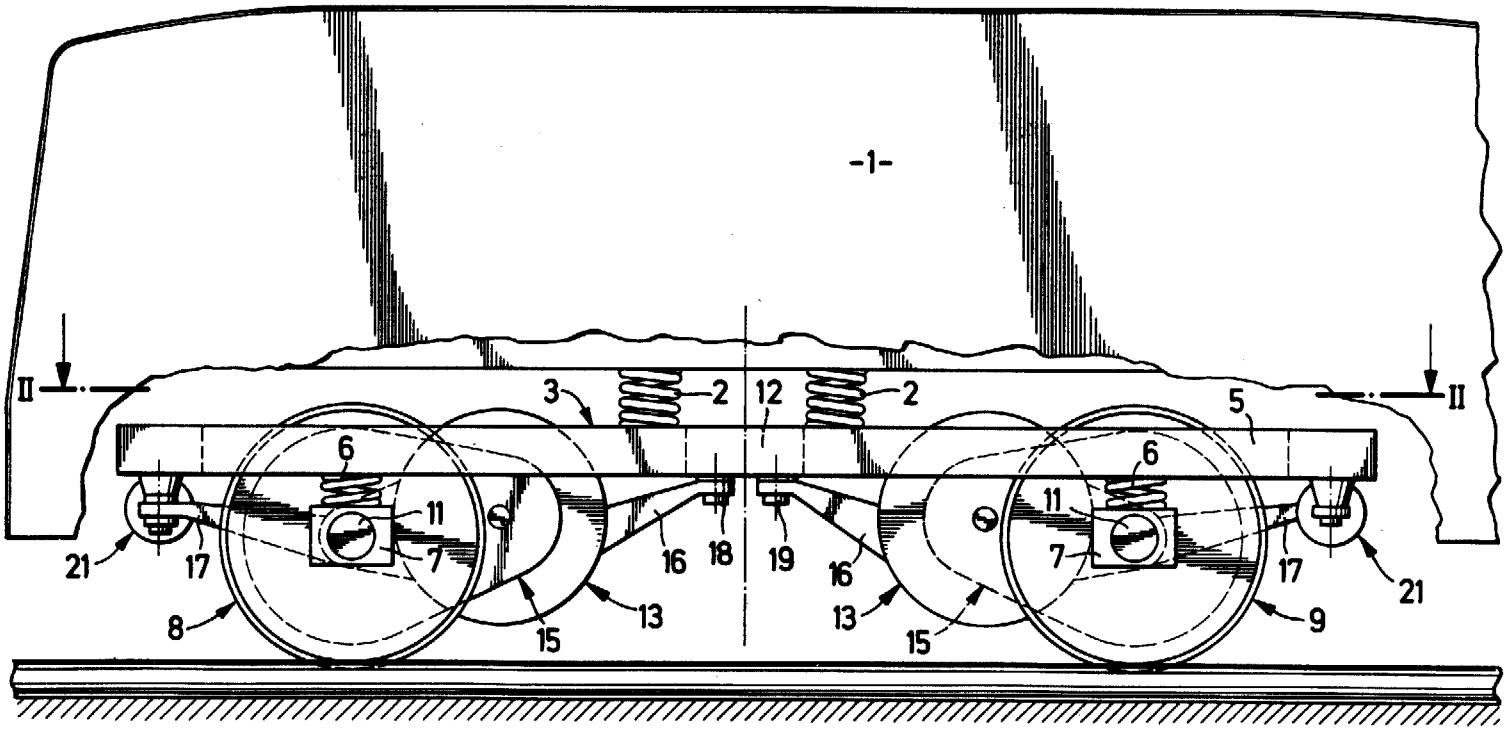
FIG. 1 illustrates a partial side elevational view of a rail vehicle in accordance with the invention.

Referring to FIG. 1, a rail vehicle body 1 is mounted via side springs 2 on two bogies 3 (only one of which is shown for simplicity). Each bogie 3 is connected to the body 1 by way of a means (not shown) for transmitting traction and braking forces, for example, by way of a pivot at the center M of the bogie or by way of a low level traction device as is known.

Each bogie 3 has a frame 5 which is supported via springs 6 on journal bearings 7 of two wheel sets 8, 9. To this end, each wheel set 8, 9 has an axle 11 which is rotatably mounted in the side bearings 7. In addition, the bearings 7 are axially fixed with respect to the axles 11 and are connected via the springs 6 to the frame 5 so as to be movable laterally, e.g. longitudinally of the bogie frame 5, i.e. parallel to the longitudinal centerplane L of the bogie frame. The bearings 7 are thus also movable axially of the associated wheel set 8, 9. Consequently, the bearings 7 transmit no traction and braking forces and only reduced transverse forces to the frame 5.

Figure 2:
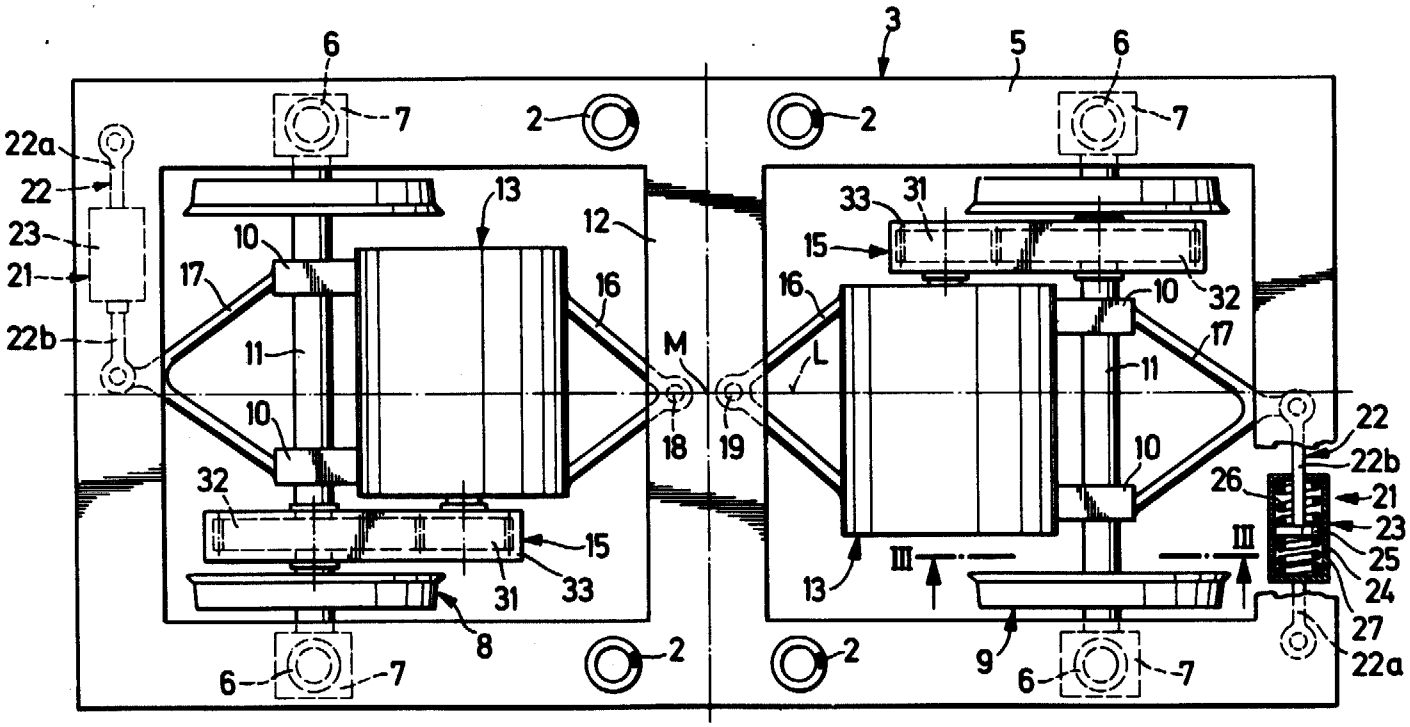
FIG. 2 illustrates a horizontal sectional view taken on line II—II of FIG. 1.

Referring to FIG. 2, each bogie frame 5 is subdivided by a central cross-member 12. In addition, two driving means in the form of motors 13 are mounted on axes parallel to the axles 11 of the wheel sets 8, 9. As shown, each motor 13 is mounted on the associated axle 11 by way of two bearings 14 (FIG. 3) which are disposed in lugs or the like 10 of a casing 20 of the motor. As shown in FIG. 2, each motor 13 is operatively connected to an axle 11 by way of a transmission member in the form of a gear box 15 in order to drive the axle 11.

The mounting arrangement for mounting the motors 13 includes two connecting members 16, 17. The first connecting member 16 which is of tow-bar-like construction is secured to the motor casing 20 and extends towards the center M of the bogie 5 while the other connecting member 17 is secured to the lugs 10 and extends towards the approximate end of the bogie frame 5.

The connecting members 16 are each pivoted to the cross-member 12 by means of two vertical pivots 18, 19, respectively, which are disposed in consecutive relationship in the longitudinal centerplane L of the bogie near the bogie center M. As shown in FIG. 1, each connecting member 16 is free to rotate about the vertical axis of the pivots 18, 19.

The other connecting members 17 are each connected to a guide means which includes a transverse link 22 which is pivotally mounted on the proximal end of the bogie frame 5. As shown in FIG. 2, each link 22 is formed of two separate elements 22*a*, 22*b* which are interconnected by a mounting 23. In addition, the mounting 23 includes a spring casing 24 which is connected to a link element 22*a*, and a cup-spring 25 which is connected to the link element 22*b* and is guided for axial movement in the casing 24 between two compression springs 26, 27. As shown, the springs 26, 27 bear on the inside of the casing 24 and oppose one another. Each link 22 is thus resilient when a predetermined spring force is exceeded.

The connecting elements 16, 17 and links 22 are rigidly connected to the respective pivots by means of an interposed insert of an elastomeric substance, e.g. on a silicone rubber base. Thus, the members and links 22 are interconnected so as to avoid sliding on one another and can therefore make relative movements to one another in space.

Referring to FIG. 2, each gear box 15 has a gear wheel pinion 31 which is mounted on the shaft of the driving motor 13 and a gear wheel 32 which meshes with the pinion 31 and is mounted on the axle 11. The gears 31, 32 are disposed in the casing 33 which is secured to the motor 13 and is so mounted on the axle 11 so as to be rotatable and axially movable.

Referring to FIG. 3, the axle 11 of each wheel set 8, 9 may be mounted for vertical movement in the respective bearing 14. Correspondingly, the gears 31, 32 (FIG. 2) can be so devised as to be axially movable relative to one another while in engagement without impairing the driving connection.

During operation, traction and braking forces are transmitted from the wheel sets 8, 9 to the cross member 12 of the bogie frame solely by way of the bearings 14, casing 20, motor 13 and connecting member 16. These forces are introduced from the bogie frame 5 into the vehicle body 1 by way of a transmission means (not shown). The journal bearings 7, which are guided by the spring 6, do not participate in the transmission of traction forces. Further, the connecting member 17 and the links 22 provide substantially rigid transverse guiding of each motor 13. However, for example, when the vehicle negotiates a curve in a rapid manner, the mountings 23 permit a resilient guiding of the motors 13 once the proportion of horizontal mass forces to be transmitted by the particular link 22 concerned exceeds a predetermined spring force of the compression spring 26 or 27. The length of each link 22 can also be varied in accordance with predetermined critical values of the horizontal forces whic arise. Thus, the motor 13 concerned and the associated axle 11 can, if required, be pivoted by a corresponding small amount around the pivot 18, 19 from the position shown in FIG. 2 and which is assumed to be parallel to the transverse center plane of the bogie 3.

Those components of the horizontal mass forces of the motors 13 which are transmitted by way of the connecting member 16 are transmitted by the pivots 18, 19 to the bogie frame 5 near the physical or imaginery vertical pivot point of the bogie.

When, for example, the vehicle is negotiating curves, the springs 6 apply an opposite axial restoring force to the axially displaced bearings 7 and, therefore, to the wheel sets 8, 9 which increases in proportion as the axial deflection increases. For this purpose, the springs 6 each have one end secured to the bearings 7 and the other end secured to the bogie frame 5.

Figure 4:
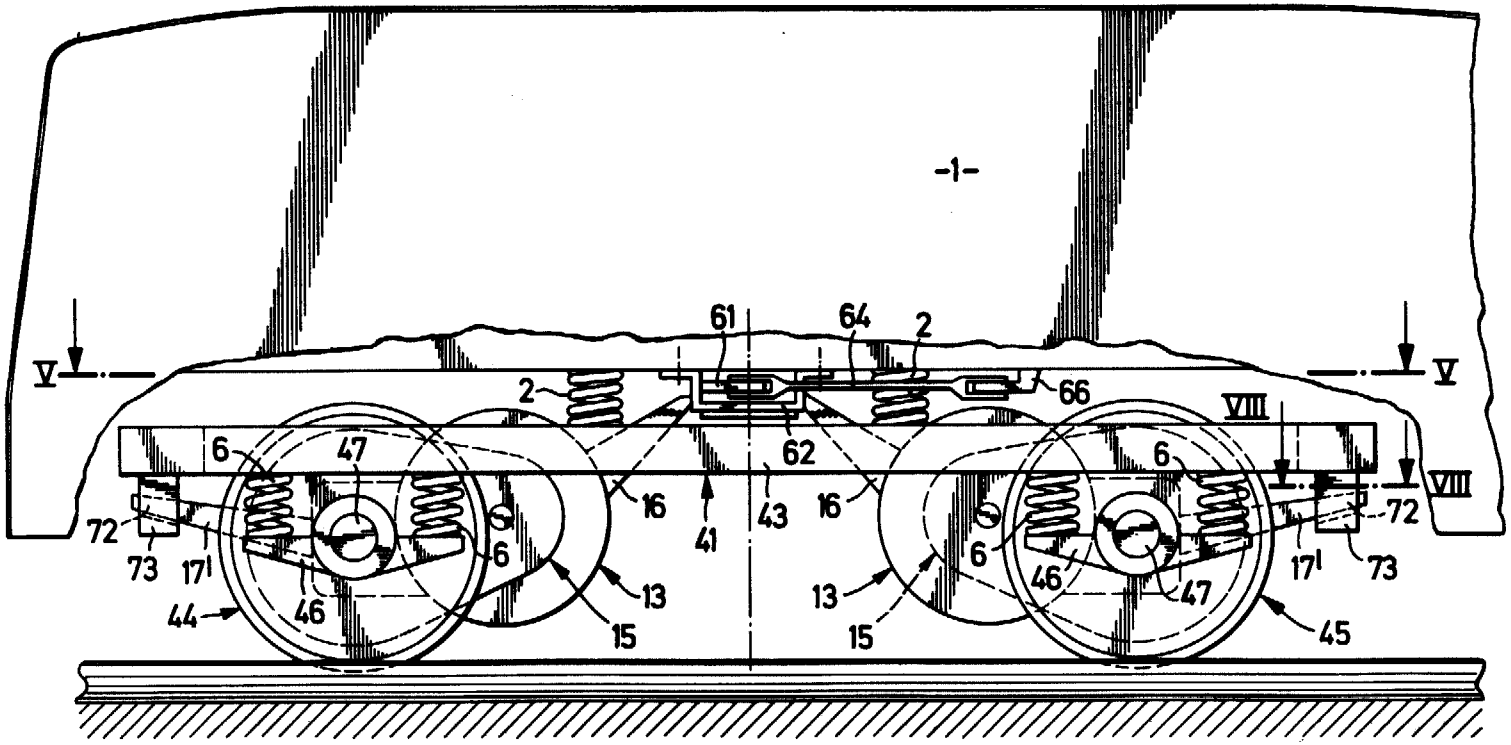
FIG. 4 illustrates a partial side view of a modified rail vehicle in accordance with the invention.
Figure 5:
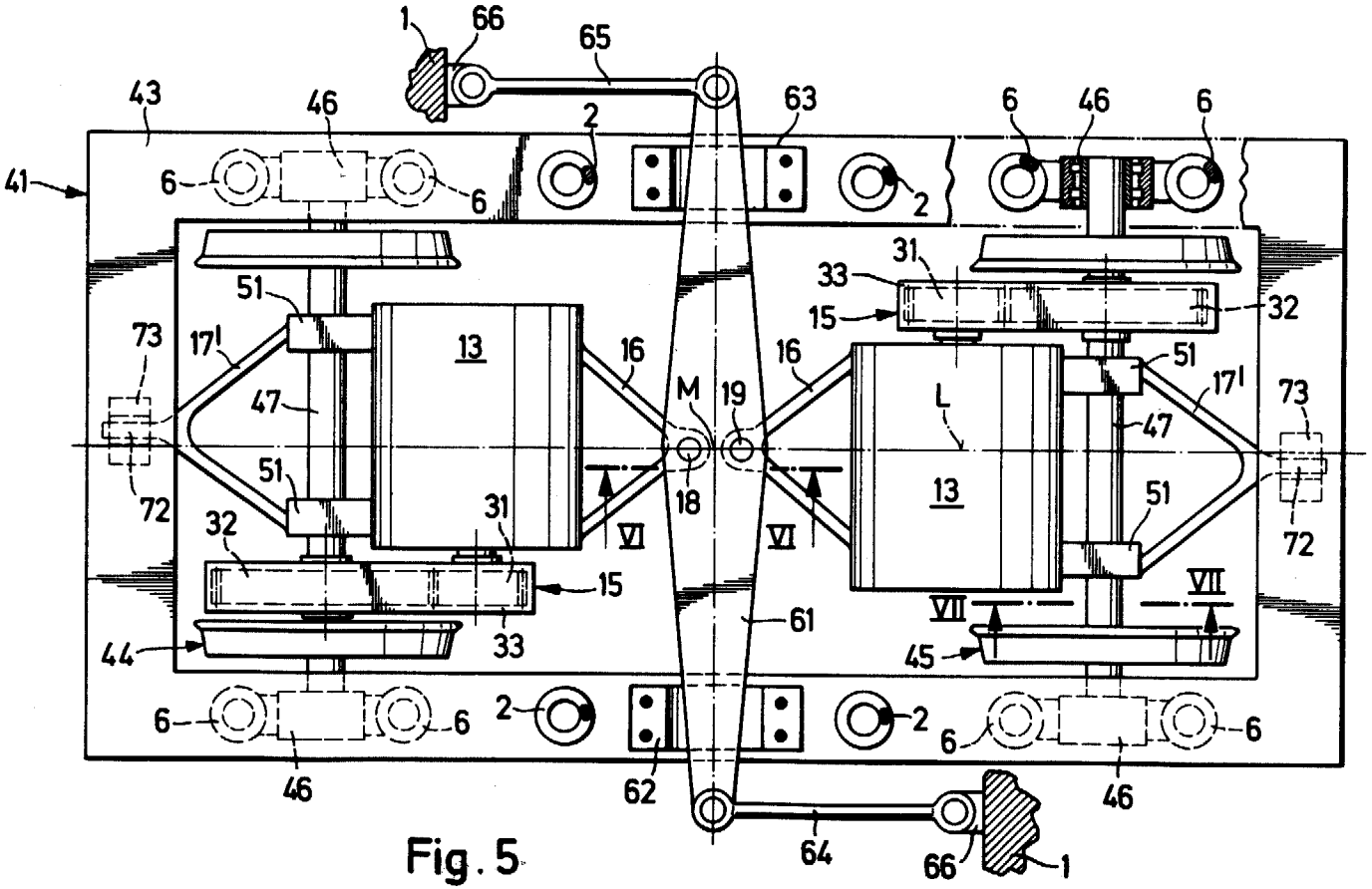
FIG. 5 illustrates a view taken on line V—V of FIG. 4.

Referring to FIGS. 4 and 5, wherein like reference characters indicate like parts as above, the bogie 41 may alternatively be connected to the vehicle body 1 by way of a guide means (not shown). Further, each bogie 41 includes a frame 43 which is carried on journal bearings 46 of two wheel sets 44, 45. The suspension system for supporting the frame 43 on each wheel set 44, 45 includes two springs 6 which are disposed on each of the bearings 46 and carry the frame 43. Each wheel set 44, 45 has an axle 47 which is mounted for axial movement in each respective bearing 46. Also, the bearings 46 are adapted to move relative to the bogie frame 43 in parallel to the longitudinal center plane L of the frame 43 and axially of the wheel sets 44, 45.

As in FIG. 2, each driving motor 13 is carried on the associated axle 47 by way of two nose bearings 51 on the motor casing 20 and is connected to an axle 47 via a gear box 15. Each axle 47 is also mounted for axial movement in two bearings 52 (see FIG. 7) which are each guided for vertical movement in a guide 53 in a corresponding nose bearing 51 between two vertical guideways 54, 55 parallel to the axle 47. The bearings 52 are retained in a central position in the slideways 53 by two compression springs 56, 57 which are disposed on opposite sides of the bearing 52.

The connecting members 16 of the respective motors 13 are pivotally connected to a transverse traction cross-bar 61 near the bogie center M. As shown in FIG. 4, the cross-bar 61 is disposed above the bogie frame 43 and is mounted for movement in two retaining members 62, 63 which are secured on each side of the vehicle body 1. As shown in FIG. 5, the ends of the cross members 61 are pivotally connected to oppositely directed draw or traction rods 64, 65 which are disposed in parallel to the longitudinal center plane L of the bogie. The opposite ends of each draw bar 64, 65 is pivoted to a bracket 66 projecting from the vehicle body 1.

The tow-bar-like connecting member 17' are each secured to a pair of nose bearings 51 and includes a longitudinally extending slide bar 72 which extends towards the proximal bogie end and which has side walls 75 extending parallel to the longitudinal center plane L of the bogie. As shown in FIG. 8, the side walls 75 of the bar 72 are slidably guided for longitudinal and vertical movement between two guideways of a guide member 73 secured on the bogie frame 43. Consequently, the connecting member 17' and the associated motor 13 have a substantially rigid transverse connection to the bogie frame.

During operation, the traction and braking forces are transmitted directly from the wheel sets 44, 45 to the vehicle body 1 without stressing of the bogie frame 43. The forces are transferred via the cross bar 61, which is free to move relative to the frame 43, and the rods 64, 65. The wheel sets 44, 45 have substantially complete freedom of movement relative to the frame 43 and can, therefore, readily execute relative movements corresponding to the state of the track or its curvature.

As shown in FIG. 6, the connecting members 16 are connected to the cross-bar 61 via pivots 18, 19. For this purpose, the draw bar 61 may be of an H-shape or slotted cross-section so as to accommodate the ends of the connecting member 16.

Figure 9:
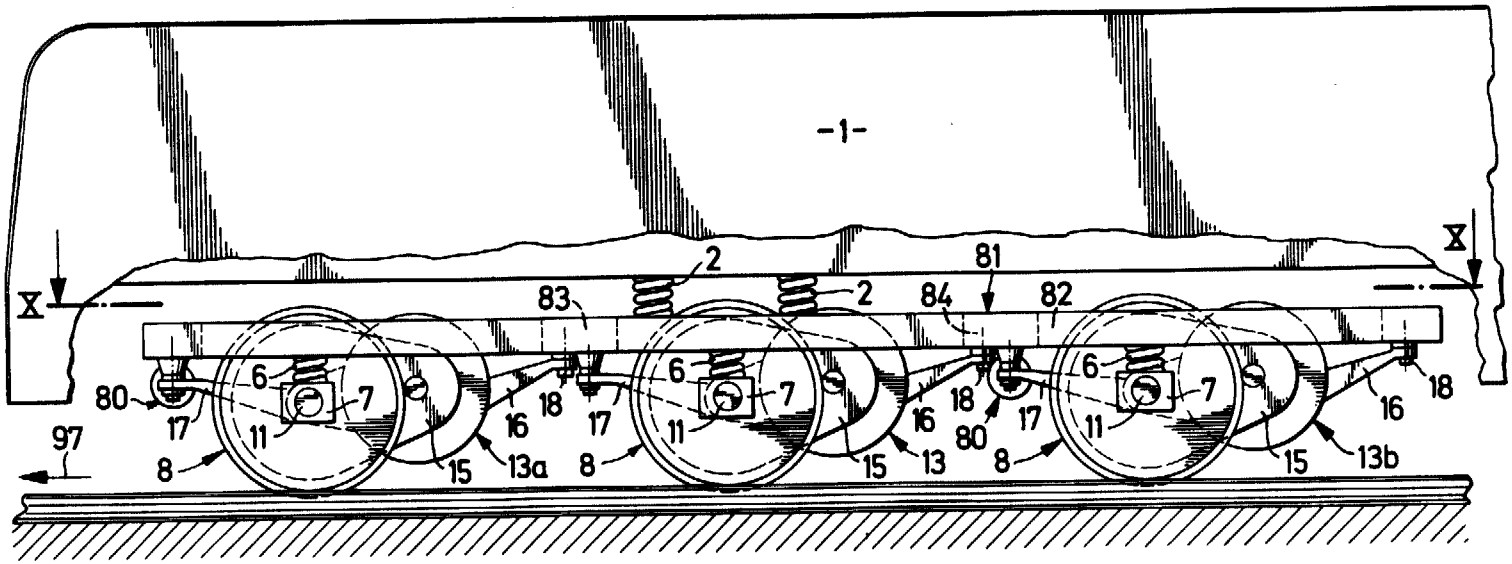
FIG. 9 illustrates a partial view in side elevation of a rail vehicle according to the invention having a six-wheeled bogie.
Figure 10:
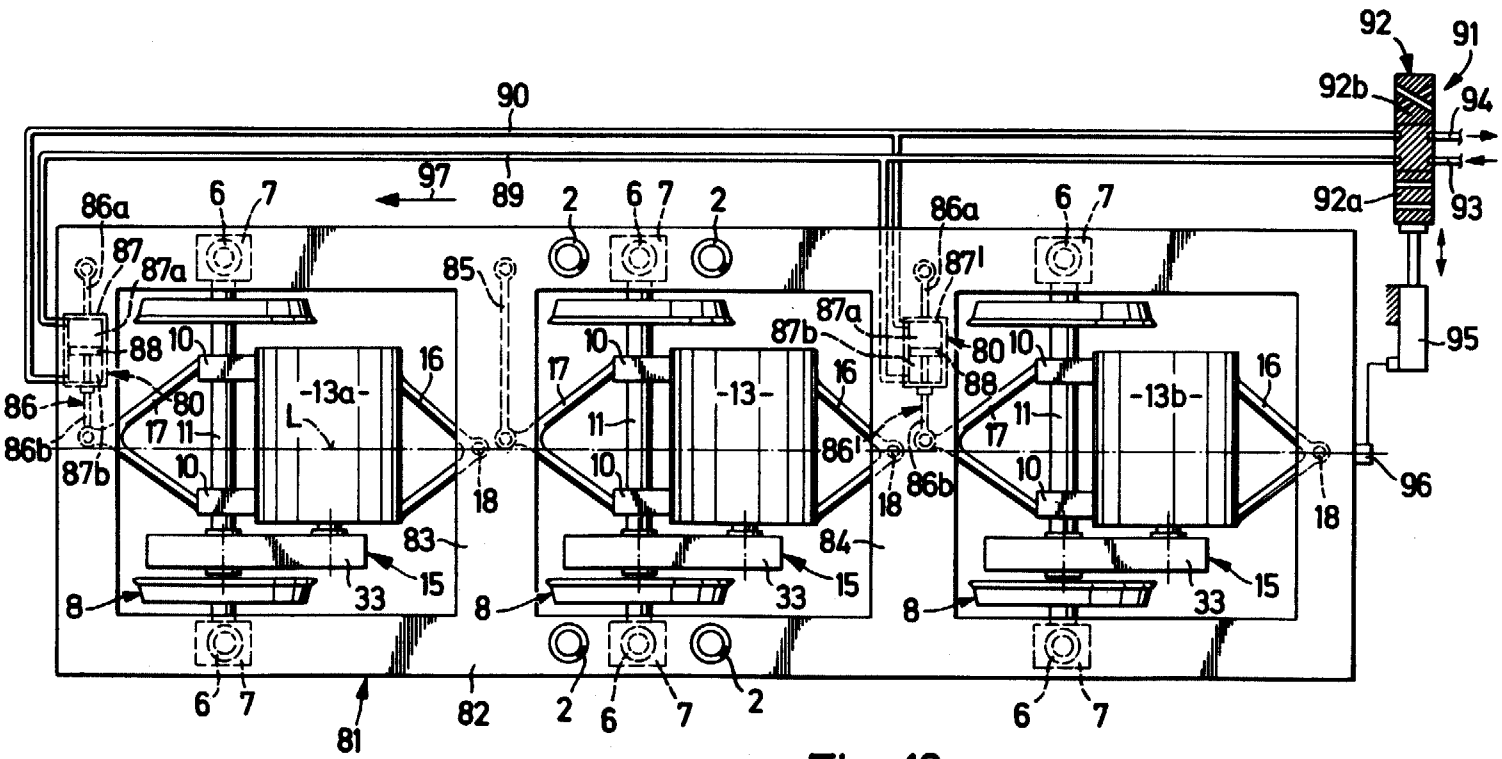
FIG. 10 illustrates a view taken on line X—X of FIG. 9.

Referring to FIGS. 9 and 10, wherein like reference characters indicate like parts as above, a rail vehicle 1 may be supported on two six-wheeled bogies 81 which are connected to the vehicle body 1 by way of guide means (not shown). In this case, each bogie 81 includes a frame 82 which is subdivided by two cross-members 83, 84. The frame 82 is carried on journal bearings 7 of three wheel sets 8 having driving motors **13, 13*a*, 13*b* which are arranged with all of the connecting members 16, 17 extending in the same longitudinal direction. The motors 13, 13*a*, 13*b* are pivotally connected by way of the respective members 16 to the proximal cross members 83, 84 and to the edge member of the frame 82. In each case, the connection point is near the longitudinal center plane L of the bogie. The connecting members 17 are pivotallly connected to transverse links 85, 86, 86' which are, in turn, pivotally connected to a side member of the frame 82. The link 85 associated with the central motor 13 is rigid but the links 86, 86' associated with the two outermotors 13*a*, 13*b* each form a guide device 80 having two parts or elements 86*a*, 86*b* which are movable transversely relative to one another. The parts 86*a* are pivoted to the frame 82 and each has a compression cylinder 87, 87' while the parts 86*b* are connected to the connecting member 17 and each have a piston 88 which acts as a divider in the corresponding cylinder 87, 87' between two pressure chambers 87*a*, 87*b***.

As shown in FIG. 10, the two cylinders 87, 87' are connected to two pressure lines 89, 90 which provide a cross-connection between the cylinder chambers **87*a*, 87*b* and which extend to a control valve 92 of a control means 91. The valve 92 is connected to a supply line 93 which, in turn, is connected to a hydraulic fluid supply (not shown) and to a discharge line 94. The valve 92 is also coupled with actuating means 95 which are adapted to change the valve 92** over between three operative positions.

The actuating means 95 is controlled relative to a reference mark on the vehicle body in dependence on the position of a sensor 96 on the bogie frame 82. For example, when the bogie frame 82 rotates in a counterclockwise manner as viewed in FIG. 10, beyond a predetermined angle, the valve 92 moves from the position shown in FIG. 10 where the supply of hydraulic fluid to both lines 89, 90 is blocked into a position 92*a* in which the valve 92 connects the supply line 93 to the line 89 and the line 90 to the discharge line 94. Correspondingly, when the bogie frame 82 performs a clockwise rotation, the valve 92 moves into a position 92*b* in which the line 90 is connected to the line 93 and the line 89 is connected to the line 94.

When the vehicle is running in a direction of travel assumed as indicated by the arrow 97 in FIG. 10, the leading bogie 91 performs a counterclockwise rotation as described above when the vehicle negotiates a left-hand curve. Correspondingly, hydraulic medium flows to the valve 92 which has moved into the position 92*a*, and through line 89 in order to increase the pressure in the cylinder chamber 87*a* in the cylinder 87 and in the cylinder chamber 87*b* of the cylinder 87'. Thus, the motor 13*a* pivots in a counterclockwise manner around the pivot 18 and the motor 13*b* pivots in a clockwise manner in the respective pivot 18. Correspondingly, the associated axles 11 are each forced to take up at least a substantially radial position relative to the curve which is being negotiated.

When the vehicle negotiates a right-hand curve when running in the same direction, the hydraulic medium is supplied through the valve 92, which is now in the position 92*b*, and through the line 90 to increase the pressure in the chambers 87*b* and 87*a* of the cylinders 87, 87', respectively. Thus, the axles 11 experience a corresponding adjustment but in the opposite direction to that discussed above.

The control system for adjusting the connecting member 17 and thus the axles 11 is thus of relatively simple construction.

Figure 11:
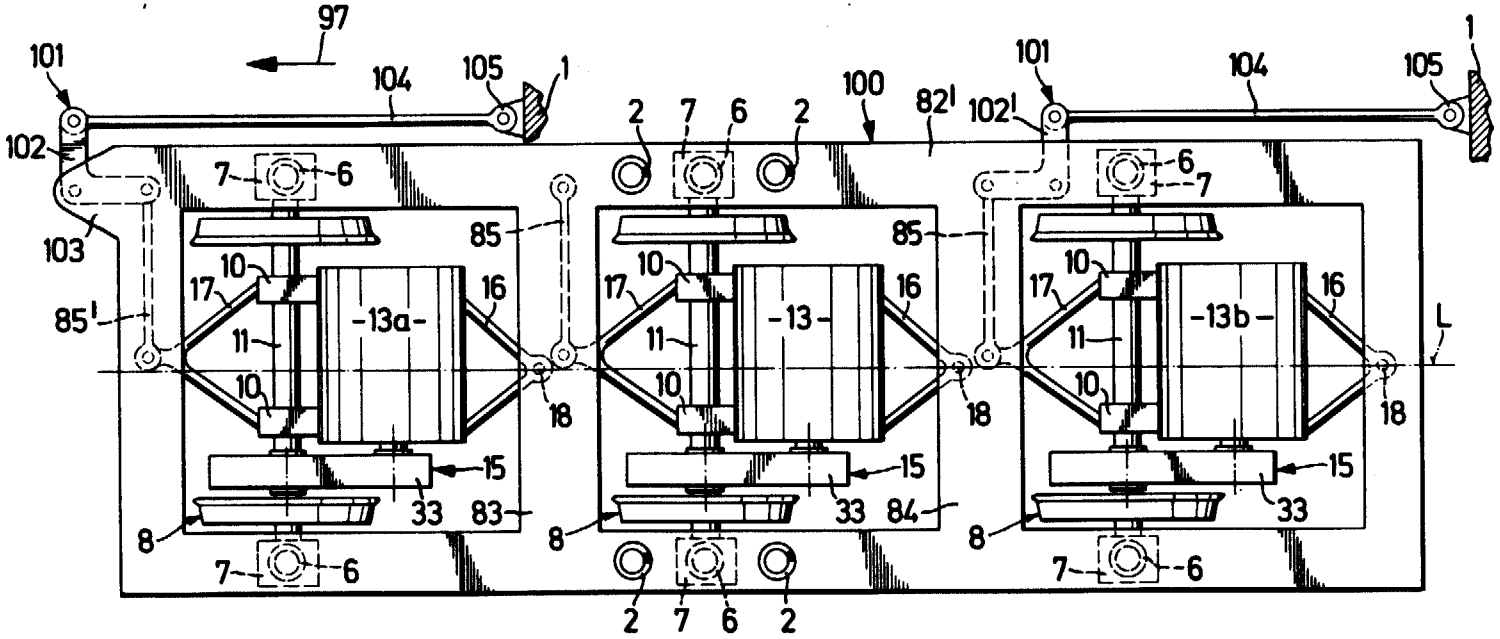
FIG. 11 illustrates a horizontal sectional view of a six wheeled bogie frame for a rail vehicle in accordance with the invention.

Referring to FIG. 11, wherein like reference characters indicate like parts as above, the mounting arrangement can be constructed without a control means as described with respect to FIGS. 9 and 10. To this end, the connecting member 17 of the two outermotors 13*a*, 13*b* are each connected to a transverse link 85 of a moving guide means 101. As shown, each linke 85' is connected to one arm of a bell crank lever 102, 102' which is pivoted to a bracket 103 on the side member of the bogie frame 82'. The lever arms which are connected to the links 85' face one another. Further, the bell crank levers 102, 102' are each connected to a traction rod 104 which is disposed in parallel to the longitudinal axis of the vehicle body 1. These two rods 104 are each pivotally connected to a bracket 105 on the vehicle body 1.

During operation, when the vehicle moves in a direction indicated by the arrow 97 and negotiates a left-hand curve, the leading bogie 100 is turned in a counterclockwise manner. The corresponding movement relative to the brackets 105 on the vehicle body 1 of the bell-crank lever pivot points on the bogie 82' produce a clockwise rotation of the levers 102, 102' to a corresponding angle. The motor 13*a* pivots counterclockwise corresponding to the arrangement of the lever arms while the motor 13*b* pivots in a clockwise manner about the associated pivots 18. Thus, the axles 11 move into a radical position relative to the left-hand curve being negotiated by the vehicle.

Figure 12:
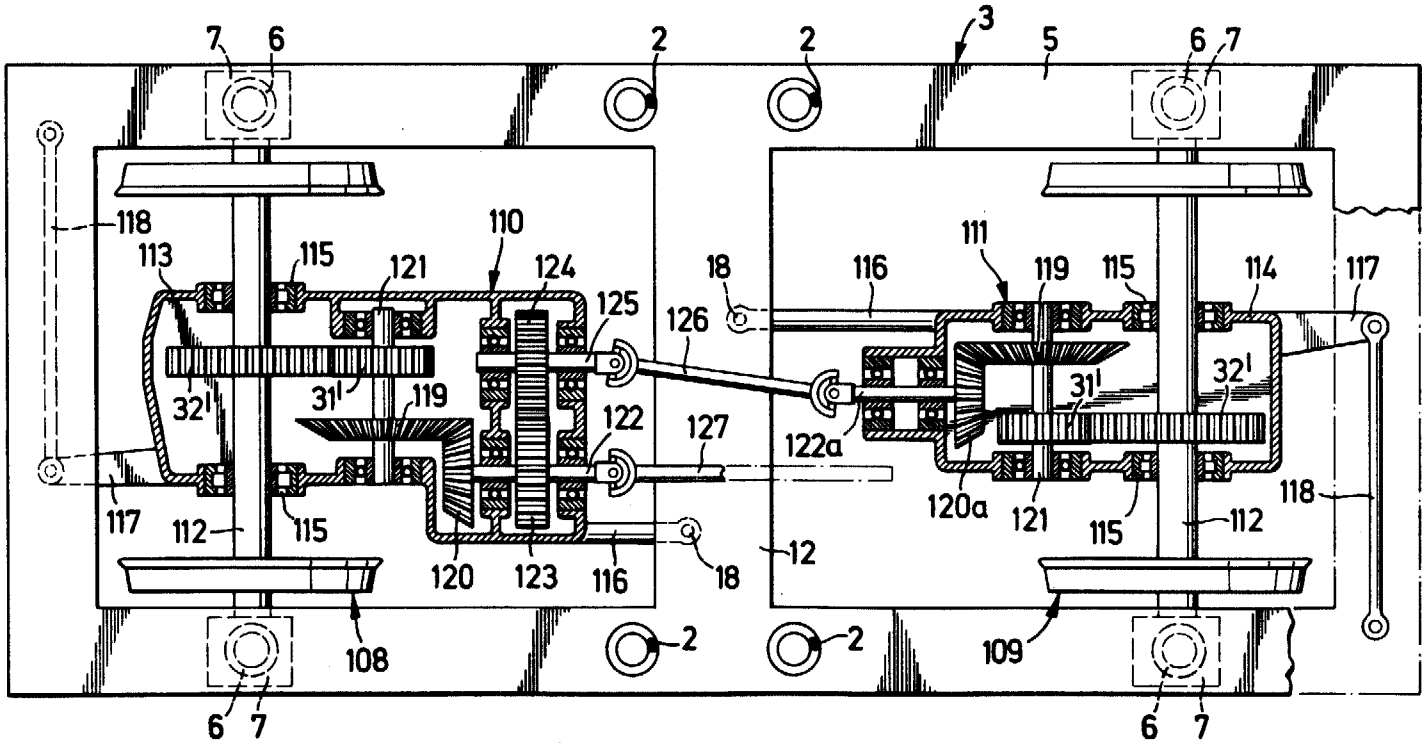
FIG. 12 illustrates a horizontal sectional view of a four-wheeled bogie frame for a rail vehicle in accordance with the invention.

Referring to FIG. 12, wherein like reference characters indicate like parts as above, a bogie frame 5 is carried on two wheel sets 108, 109 which are each coupled via a respective gear box 110, 111 with a driving motor (not shown) disposed on a vehicle body. The wheel-set axles 112 are each mounted for axial displacement in bearings 115 in the casing 113, 114 of the associated gearbox 110, 111. The casings 113, 114 have connecting members 116, 117 extending in two longitudinal directions of the bogie. The members 116 serve to transmit traction and braking forces and are each pivoted to a cross-member 12 of the bogie frame 5. The connecting members 117 serve to transmit transverse forces and are each pivotally connected to a rigid transverse link 118 whose other end is pivotally connected to the bogie frame 5.

The gearboxes 110, 111 each comprise a gearwheel 32' secured to the axle 112; a pinion gear 31' meshing with the gearwheel 32'; a bevel gear 119; and a bevel gear 120, 120*a* engaging with the bevel gear 119. The gears 31' are each disposed with the bevel gear 119 on a common shaft 121 mounted in the casing 113, 114. The tooth system of each gear 31' is such as to permit axial movements of the gear 119. The gears 120, 120*a* are each disposed on a shaft 122, 122*a* mounted in the casing 113, 114 respectively. The gearbox 110 also comprises reversing gearing having a gear 123 secured to the shaft 122 and a gear 124 disposed on a shaft 125 mounted in the casing 113. The shaft 125 is coupled with the shaft 122*a* by a universal shaft 126. The shaft 122 is coupled by way of a universal shaft 127 with the shaft of the driving motor which is disposed on the vehicle body and which drives the two wheel sets 108, 109.

Various other embodiments are also possible. For instance, the longitudinally movable journal bearings of the wheel sets can be connected to the bogie frame so as to be axially fixed. In this case, the total lateral deflection of the axle is taken up by the movement of the axle relative to the side bearings. Also, the axles can be mounted in the bearings so as to be axially fixed on the associated motor or gearbox casing, the latter bearings being so connected to the particular casing concerned as to be movable either axially or axially and vertically. Also, each of the motors can be guided by a transversely rigid link.

In constructions in which the connecting member 17' is slidably guided (FIGS. 4 and 5), the associated guide member or the connecting member can have a transversely resilient spring element. In controlled-axle constructions, the actuating means, so as means 95 in FIG. 10, can be controlled by a signal from the track or from a driving cab, for instance, by way of a digital control. A corresponding pneumatic or electric facility can of course be used instead of a hydraulic or mechanical control facility.

What is claimed is:

1. A rail vehicle comprising a body;

at least two bogies supporting said body each bogie having a frame;

at least two wheel sets mounted in each bogie, each wheel set having an axle and a pair of journal bearings having said axle rotatably mounted therein and a respective bogie frame supported thereon, each said journal bearing being movable laterally of said respective bogie;

a plurality of drive means, each drive means including a casing;

a pair of bearings mounted on each axle in axially movable relation and connected to a respective casing;

an axially movable transmission member on each axle coupling said axle to a respective drive means;

a first connecting member between each said casing and said respective bogie frame to transmit transverse forces to said respective bogie frame;

guide means connecting each said first connecting member to said respective bogie frame to permit movement of said connecting member longitudinally of said respective bogie frame; and a second connecting member connected to a respective said casing and to said body opposite from a respective first connecting member to transmit longitudinal forces to said body.

2. A rail vehicle as set forth in claim 1 wherein each said second connecting member is connected directly to a respective bogie frame and said bogie frame is connected to said body.

3. A rail vehicle as set forth in claim 1 which further comprises a cross-member pivotably secured to each said second connecting member at intermediate points thereof, and a pair of draw bars disposed longitudinally of said body, each said draw bar being pivotally secured to a respective end of said cross-member and to said body.

4. A rail vehicle as set forth in claim 1 wherein said guide means includes a transverse link pivotally connected to a respective bogie frame and a respective first connecting member.

5. A rail vehicle as set forth in claim 1 wherein each said guide means includes a pair of guideways parallel to a central longitudinal plane of said bogie and each said first connecting member includes a slider having side surfaces slidably disposed in said guideways.

6. A rail vehicle as set forth in claim 1 wherein each guide means includes a connecting element movably mounted transversely of a respective bogie frame and a mounting secured to said respective bogie frame for limiting movement of said connecting element.

7. A rail vehicle as set forth in claim 6 wherein each guide means further includes at least one transversely resilient spring element biasing said connecting element and mounting together.

8. A rail vehicle as set forth in claim 6 which further comprises a control means connected to said mounting for adjusting said connecting element.

9. A rail vehicle as set forth in claim 1 wherein each journal axle is axially fixed in said side bearings and said journal bearings are movable transversely of a respective bogie frame.

10. A rail vehicle as set forth in claim 1 which further comprises a spring secured at each end to and between a respective bogie frame and each journal bearing.

11. A rail vehicle as set forth in claim 1 which further comprises a pair of guideways for guiding each of said pair of bearings vertically, said guideways being secured to said casing.

12. A rail vehicle as set forth in claim 11 which further comprises at least one spring element between said casing and each of said pair of bearings.

13. A mounting arrangement for a drive means of a rail vehicle comprising a bogie frame;

a wheel set having an axle and a pair of journal bearings rotatably supporting said axle therein;

means connecting each said bearing to said bogie frame to support said frame thereon with each said bearing being movable relative to said frame laterally of said frame;

a drive means including a casing;

a pair of bearings mounted on said axle in axially movable relation and connected to said casing to pivotally support said casing on said axle;

an axially movable transmission member on said axle coupling said axle to said drive means;

a first connecting member connected between said casing and said bogie frame to transmit transverse forces to said frame;

guide means connecting said first connecting member to said frame to permit movement of said member longitudinally of said frame; and a second connecting member connected to said casing opposite from said first connecting member for connection to a rail vehicle body to transmit traction and braking forces to the rail vehicle body.

14. A rail vehicle comprising a vehicle body;

at least two bogies for supporting said body, each bogie having a frame and at least two wheel sets supporting said frame, each wheel set including having an axle and a pair of journal bearings rotatably mounting said axle therein with a respective bogie frame supported thereon, each said journal bearing being movable laterally of a respective bogie frame;

a plurality of drive means, each drive means including a casing;

an axially movable transmission member on each axle coupling said axle to a respective drive means a first connecting member connected to a respective casing and said vehicle body to transmit longitudinal traction and braking forces to said body;

a pair of bearings mounted on each axle and connected to a respective casing opposite said first connecting member;

a second connecting member connected between a respective casing and said respective bogie frame opposite from a respective first connecting member to transmit transverse forces to said respective bogie frame; and a guide means mounted on a respective bogie frame to connect each second connecting member to said respective bogie frame to permit movement of said second connecting member longitudinally of said respective bogie frame.

15. A rail vehicle as set forth in claim 14 wherein each bogie includes a pair of said wheel sets and said bogie frame has a central cross-member between said wheel sets, said first connecting members of said drive means of said bogie being disposed in facing relation and pivotally connected to said cross-member.

* * * * *